United States Patent [19]

McLeod

[11] Patent Number: 4,601,494

[45] Date of Patent: Jul. 22, 1986

[54] NIPPLE INSERT

[76] Inventor: Roderick D. McLeod, 5104 125th Street, Edmonton, Alberta, Canada, T6H 3V5

[21] Appl. No.: 478,365

[22] Filed: Mar. 24, 1983

[30] Foreign Application Priority Data

Apr. 5, 1982 [CA] Canada ..... 400445

[51] Int. Cl.[4] ..... F16L 17/00

[52] U.S. Cl. ..... 285/110; 285/347; 285/351; 285/379

[58] Field of Search ..... 285/379, 139, 110, 351, 285/347, 345, 302

[56] References Cited

U.S. PATENT DOCUMENTS

| | | | |
|---|---|---|---|
| 1,173,211 | 2/1916 | O'Donnell | 285/351 |
| 2,031,754 | 2/1936 | Bacigalupi | 285/302 |
| 2,245,963 | 6/1941 | Crickmer | 285/347 |
| 2,477,533 | 7/1949 | Whiting . | |
| 2,935,343 | 5/1960 | Ellis . | |
| 3,226,137 | 12/1965 | Trnka | 285/379 |
| 3,573,871 | 4/1971 | Warner . | |
| 3,791,678 | 2/1974 | De Putter . | |

FOREIGN PATENT DOCUMENTS

| | | | |
|---|---|---|---|
| 455784 | 4/1949 | Canada . | |
| 773391 | 12/1967 | Canada . | |
| 1094945 | 2/1981 | Canada . | |
| 2151664 | 4/1973 | Fed. Rep. of Germany | 285/110 |

OTHER PUBLICATIONS

Composite Catalog of Oil Field Equipment & Sales, 33rd Revision, 1978–1979, published by World Oil, pp. 72–73.

*Primary Examiner*—Cornelius J. Husar
*Assistant Examiner*—Eric K. Nicholson
*Attorney, Agent, or Firm*—Parkhurst & Oliff

[57] ABSTRACT

A nipple for use in a Christmas tree bypass tool has an outer, molded rubber sleeve thereon and an inner steel insert, a portion of which forms a seal against a skirt on the rubber sleeve. The seal between the insert and the skirt prevents high pressure in the tool from reaching and acting on the bond between the rubber sleeve and the nipple.

2 Claims, 3 Drawing Figures

NIPPLE INSERT

FIELD OF THE INVENTION

This invention relates to oil field service tools and in particular to a nipple for use in such tool.

BACKGROUND OF THE INVENTION

In the process of servicing wells in the oil field industry such as pumping substances into or out of oil or gas wells, a device referred to as a Christmas tree bypass tool may be used. These tools have been used for many years and all of such tools utilize a pack off nipple of which numerous sizes and configurations are presently available to fit the different sizes of tubing and casing that may be in the well. Conventionally, the typical nipple is cylindrical in shape as is the tubing that they seal in. The outer surface of the nipple has a rubber sleeve bonded to the steel surface of the nipple, the outside diameter of the rubber sleeve being slightly larger than the inside diameter of the tubing in which the nipple is installed so that when the nipple is initially inserted in the tool, a slight seal is effected. Subsequently, when fluid or gas is pumped through the tool at high pressure, this pushes the skirt of the rubber sleeve against the tubing to create a better seal. However, this pressure also acts on the rubber bond between the sleeve and the surface of the steel nipple and can separate the rubber from the steel allowing the high pressure fluid or gas to leak past the sleeve to the low pressure area, resulting in a failure of the job.

SUMMARY OF THE INVENTION

The present invention provides an improved nipple construction which prevents high pressure in the tool from reaching the bonding area between the rubber sleeve and the outer surface of the nipple body. Briefly, the rubber sleeve has a unique configuration and cross-section and a concentrically located steel insert is used on the inside of the nipple and sleeve. The shape of the insert can vary but the sealing action will be the same. The insert, when secured on the inside of the nipple, effects the seal in the area leading to the bonding surface so that high pressure in the tool cannot reach the bonding area. Additionally, the upper end of the insert may be further sealed between its terminal end and the juxtaposed area of the nipple to prevent high pressure from coming back through the threads to the bonding area. Accordingly, no part of the rubber to steel bond is subjected to any of the high pressure. Thus, the insert mechanically seals any access to the rubber to steel bond.

According to a broad aspect, the present invention relates to a nipple for use in a bypass tool, the nipple comprising a tubular body with a threaded upper end for securing the nipple into said tool and a lower end of reduced outer diameter with a resilient sleeve molded thereon for sealing the exterior of the nipple in the well tubing. A tubular insert is coaxially located and secured on the inside of the nipple, the insert having an outer shoulder sealingly engaging an area of the resilient sleeve adjacent thereto to prevent high pressure in the tool from reaching the bonded area between the resilient sleeve and the outer surface of the nipple body.

A seal member may also be provided between the upper end of the insert and the nipple to prevent the high pressure in the tool from entering the area between the outer surface of the insert and the inner surface of the nipple.

BRIEF DESCRIPTION OF THE DRAWINGS

The invention is illustrated by way of example in the accompanying drawings in which.

DETAILED DESCRIPTION OF THE PREFERRED EMBODIMENT

Figure 1:
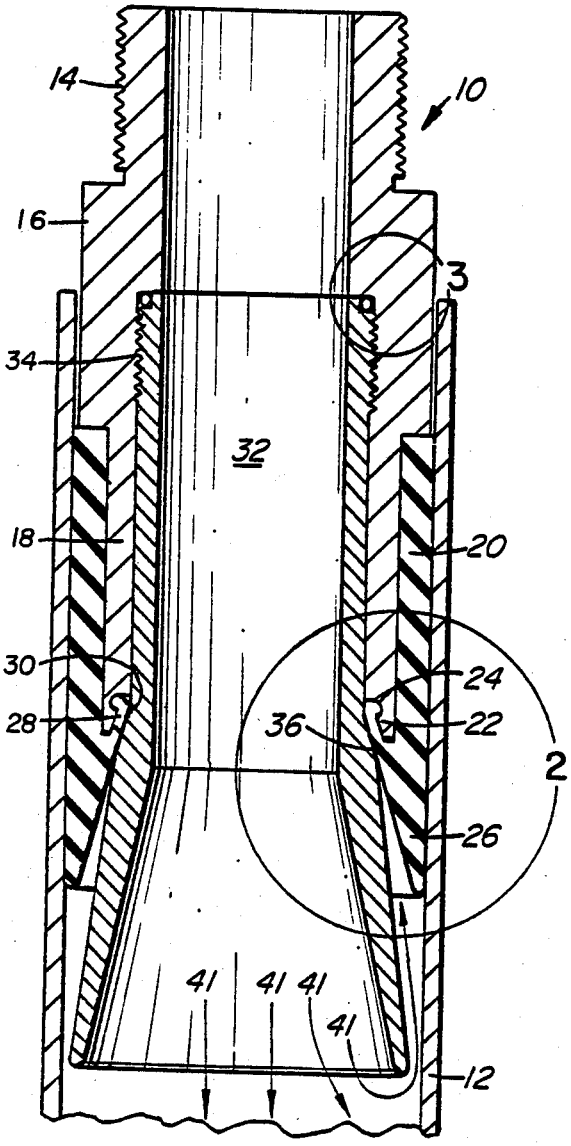
FIG. 1 is a cross-section through a portion of well tubing showing the nipple therein.

Referring to FIG. 1 a nipple generally indicated at 10 is inserted into the well tubing 12. The nipple 10 has a threaded upper end 14 for detachable connection to another tubular member at its upper end. The main body 16 of the nipple is slightly smaller in diameter than the inside diameter of the tubing 12 and the lower end 18 of the nipple is of reduced outer circumferential diameter and a resilient sleeve 20, preferably rubber, is positioned over the portion of reduced diameter and is bonded thereto. The outer diameter of the resilient sleeve 20 is slightly larger than the inside diameter of the tubing 12 so that when the nipple 10 is initially inserted into a bypass tool, a slight seal is effected between the outer wall of the sleeve and the inner wall of the tubing.

The lower terminal end of the nipple 10 has a relieved circumferential area 22 on its inner surface to give a somewhat flared look to the end of the nipple in cross-section, the upper end of the relieved section terminating in a deeper groove 24.

Figure 2:
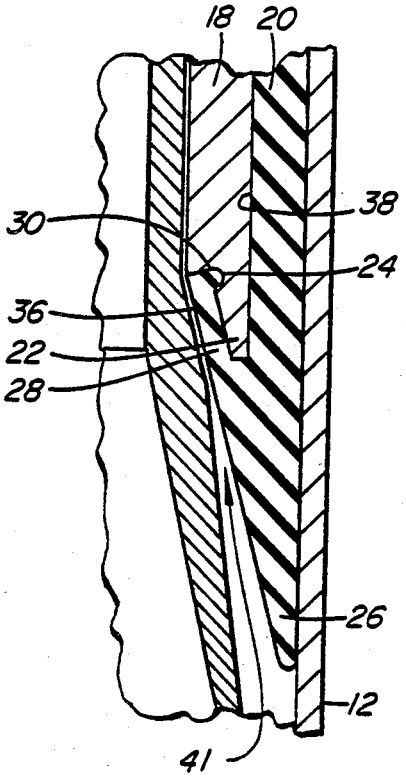
FIG. 2 is an enlarged, fragmentary portion of FIG. 1 shown enlarged.

The resilient sleeve 20 has a depending skirt portion 26 that extends beyond the lower end of the nipple body 16, the skirt providing flexibility to the nipple when the latter is being inserted into the tubing 12 and the skirt being pressed outwardly against the adjacent wall of the tubing 12 when subjected to high pressure in the nipple 10 and tubing 12 as shown by the arrows, 41. The skirt 26 has, at its inner end, an upwardly directed flange 28 having a lip 30 on its upper end directed outwardly with respect to the nipple 10. As seen in FIG. 2, the skirt flange 28 and lip 30 seat against the relieved area and groove 24 respectively on the lower end of the nipple body 16.

The nipple 10 is provided with a further element in the form of a tubular insert 32 which is placed on the inside of the nipple and secured therein in any conventional manner, a threaded connection 34 being illustrated by way of example only. The main body of the insert 32 is cylindrical, the inside diameter thereof being approximately the same as the inside diameter of the nipple. The lower end of the insert 32 has a flared portion, providing a frusto conical shoulder 36 which, when the insert is placed in the position shown on FIG. 1, applies sealing pressure against the flange 28 and lip 30 of the skirt 26 thereby preventing the high pressure in the nipple 10 and tubing 12 from reaching and acting on the area of bond 38 between the inner surface of the resilient sleeve and the outer surface of the reduced portion 18 of the nipple.

Figure 3:
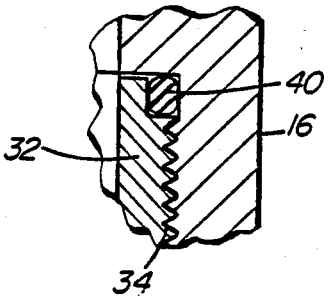
FIG. 3 is another fragmentary portion of FIG. 1 shown an enlarged scale.

In order to further ensure that the high pressure in the tubing 12 and nipple 10 does not come through the area of connection between the insert and the inner surface of the nipple, i.e. the threads 34, an O-ring seal 40 as shown in FIG. 3 is located at the upper end of the insert 32 to prevent such a pressure leak.

It will be appreciated that with the sealing arrangement of the present invention, there is no part of the bond between the insert body and the resilient sleeve which is subjected to any high pressure, the insert 32 mechanically sealing the access to this bond.

It will be further appreciated that the shape of the seal area, the shape of the insert and whether the insert is threaded or is forced in and pinned in place constitute various modifications of the invention that will occur to those skilled in the art without departing from the spirit and scope of the invention as set forth in the appended claims.

The terms and expressions employed in the specification have been used as terms of description and not of limitation and there is no intention in the use of these terms and expressions to exclude any equivalents of the features shown and described or portions thereof. It is recognized that various modifications are possible within the scope of the invention claimed.

The embodiments of the invention in which an exclusive property or privilege is claimed are defined as follows:

1. A nipple for use in a bypass tool, said nipple comprising:

(a) a tubular body with a threaded upper end for securing the nipple into said tool and a lower end of reduced outer diameter;

(b) a resilient sleeve molded on said reduced outer diameter of said nipple lower end and providing a bonding area therebetween, said resilient sleeve providing a seal between the exterior of said nipple and a well tubing;

(c) an inner groove on the lower end of said nipple;

(d) said resilient sleeve having a skirt portion on the lower end thereof defined by an inner frusto-conical portion, and a flange on the top end of said skirt portion, said flange having an outwardly directed lip received in said annular groove of said nipple; and (e) a tubular insert coaxially located and secured on the inside of said nipple, said insert having an outer bevelled shoulder portion sealingly engaging the top end of said skirt portion of said resilient sleeve and forcing said lip thereof into said annular groove of said nipple to prevent high pressure in said tool from reaching said bonding area between said resilient sleeve and the outer surface of the nipple body;

(f) said frusto-conical skirt portion of said resilient sleeve defining a peripheral space between the inner surface of said skirt portion and the adjacent, outer surface of the tubular insert so that pressure flowing through the nipple forces the skirt portion outwardly into a firmer sealing engagement with said tubing.

2. A nipple according to claim 1 including a seal member between the upper end of said insert and the nipple to prevent high pressure in said tool from entering the area between the outer surface of the insert and the inner surface of the nipple.

* * * * *